US012030694B2

(12) United States Patent
Liu

(10) Patent No.: US 12,030,694 B2
(45) Date of Patent: Jul. 9, 2024

(54) STORAGE BOX WITH ROTATABLY CHANGING COMPARTMENTS

(71) Applicants: PRAIRIE PLASTIC HARDWARE CO., LTD., DongGuan (CN); FREE-FREE INDUSTRIAL CORP, Taipei (TW)

(72) Inventor: Sheng-Yu Liu, Taipei (TW)

(73) Assignees: PRAIRIE PLASTIC HARDWARE CO., LTD., Dongguan (CN); FREE-FREE INDUSTRIAL CORP, Taipei (TW)

( * ) Notice: Subject to any disclaimer, the term of this patent is extended or adjusted under 35 U.S.C. 154(b) by 92 days.

(21) Appl. No.: 17/792,343

(22) PCT Filed: Feb. 10, 2020

(86) PCT No.: PCT/CN2020/074595

§ 371 (c)(1),
(2) Date: Jul. 12, 2022

(87) PCT Pub. No.: WO2021/159227

PCT Pub. Date: Aug. 19, 2021

(65) Prior Publication Data

US 2023/0051160 A1 Feb. 16, 2023

(51) Int. Cl.
*B65D 25/06* (2006.01)
*B65D 51/24* (2006.01)

(52) U.S. Cl.
CPC ..... *B65D 25/06* (2013.01); *B65D 51/246* (2013.01)

(58) Field of Classification Search
CPC ..... B65D 25/06; B65D 25/04; B65D 25/02; B65D 85/08; B65D 83/0445;
(Continued)

(56) References Cited

U.S. PATENT DOCUMENTS 2,188,249 A * 1/1940 Pringsauf ..... B65D 83/0083 222/548
3,720,346 A 3/1973 Cypher
(Continued)

FOREIGN PATENT DOCUMENTS

CN 207412567 U 5/2018
CN 207791455 U 8/2018
(Continued)

OTHER PUBLICATIONS

Search Report dated Feb. 10, 2020 of the corresponding PCT patent application No. PCT/CN2020/074595.

*Primary Examiner* — Robert Poon
(74) *Attorney, Agent, or Firm* — Chun-Ming Shih; HDLS IPR SERVICES

(57) ABSTRACT

A storage box with rotatably changing compartments includes a box body, a partition board and a box cover. The box body includes a base plate and a vertical plate bent and extended from the base plate. A storage space is enclosed by the vertical plate and the base plate. The base plate includes a hinge portion. The partition board includes a board member and a rotating portion arranged on the board member, and the board member is rotatably attached to the hinge portion correspondingly, and the storage space is divided into a first compartment and a second compartment via the board member. The box cover correspondingly covers the box body. Accordingly, the internal space of the box body may be adjusted depending upon the actual needs to achieve easy operation and convenient use thereof.

8 Claims, 7 Drawing Sheets

(58) Field of Classification Search
CPC ..... B65D 83/0454; B65D 83/0083; B65D 7/065; B65D 90/582; B65D 39/08
USPC .... 220/529, 548, 573.1, 575, 528, 532, 533, 220/552, 281, 780, 315, 324, 574.1, 212; 206/533, 303, 560, 759, 443, 407, 565, 206/561
See application file for complete search history.

(56) References Cited

U.S. PATENT DOCUMENTS 4,261,464 A 4/1981 Maitland
5,584,412 A * 12/1996 Wang ..... B60R 7/02 220/500
6,234,343 B1 * 5/2001 Papp ..... G07F 17/0092 221/7
6,409,014 B1 * 6/2002 Hummell ..... G11B 33/0427
6,533,123 B1 * 3/2003 Nakamura ..... H01L 21/67396 206/454
D682,609 S * 5/2013 Lindsay ..... D7/392.1
2007/0205226 A1 * 9/2007 Honda ..... A45D 40/0075 222/386
2009/0250368 A1 * 10/2009 Earl ..... B65D 25/04 220/520
2018/0265256 A1 * 9/2018 Fisher, Jr. ..... A45C 11/20
2020/0163474 A1 * 5/2020 McCartney ..... A47G 19/02

FOREIGN PATENT DOCUMENTS

CN 208217298 U 12/2018
CN 210028391 U 2/2020
GB 2545475 A 6/2017
WO 2018207166 A1 11/2018

* cited by examiner

STORAGE BOX WITH ROTATABLY CHANGING COMPARTMENTS

CROSS-REFERENCE TO RELATED APPLICATION

This application is the National Phase of PCT International Application No. PCT/CN2020/074595 filed on Feb. 10, 2020. The entire disclosures of the above application are all incorporated herein by reference.

BACKGROUND OF PRESENT DISCLOSURE

Technical Field

The technical field relates to a storage box, and in particular, to a storage box with rotatably changing compartments.

Description of Related Art

With the fast growing eating-out population in modern society, relevant issues of nutritional imbalance and food hygiene often occur. Accordingly, to overcome the deficiencies in health and hygiene associated with eating-out activities along with the consideration of people's need to save meal cost, people tend to use lunch boxes for preparation of food in order to facilitate their dining outside.

Among the currently existing lunch boxes in the market, some of the lunch boxes are not equipped with the function of separate storage of rice and non-rice dishes, and the juices of such non-rice dishes tend to flow to the rice, causing the rice to become soft and being mixed with various favors due to absorption of juices of different dishes, such that the flavor of the lunch box is adversely affected.

To overcome the aforementioned drawback, the industry has developed lunch boxes with compartments. However, most of the existing lunch boxes with compartments adopt the fixed partition design, and the food residue and oil residue tend to accumulate at the corner areas of such lunch boxes, causing difficulty to cleaning, and uncleaned dead corners often occur in such lunch boxes. Furthermore, due to the limitation of the fixed partition boards on the space provided, a lot of food need to be further processed, such as bending or cutting, in order to be properly placed into the desired compartments. Consequently, the overall appearance of the food is adversely affected.

In view of the above, the inventor seeks to overcome the aforementioned drawbacks associated with the known terminal block and aims to provide an effective solution through extensive researches along with utilization of academic principles and knowledge.

SUMMARY OF PRESENT DISCLOSURE

An objective of the present disclosure is to provide a storage box with rotatably changing compartments, capable of adjusting internal space of the box body according to the actual use needs.

To achieve the aforementioned objective, the present disclosure provides a storage box with rotatably changing compartments, having a box body, at least one partition board and a box cover. The box body includes a base plate and a vertical plate bent and extended from the base plate. A storage space is enclosed by the vertical plate and the base plate. The base plate includes a hinge portion. The partition board includes a board member and a rotating portion arranged on the board member, and the board member is rotatably attached to the hinge portion correspondingly, and the storage space is divided into a first compartment and a second compartment via the board member. The box cover correspondingly covers the box body.

The present disclosure has the following technical effects, such that through the rotatable attachment between the rotating portion and the hinge portion, easy operation and convenient use of the storage box may be achieved. With the insertion manner between the insertion slots and insertion ribs, the center of the board member may be firmly positioned. The retention of the end portion of each sheet by each positioning strip may prevent deviation of the partition board and provide proper bending resistance and deformation resistance to the end portion of the board member.

DETAILED DESCRIPTION

Figure 1:
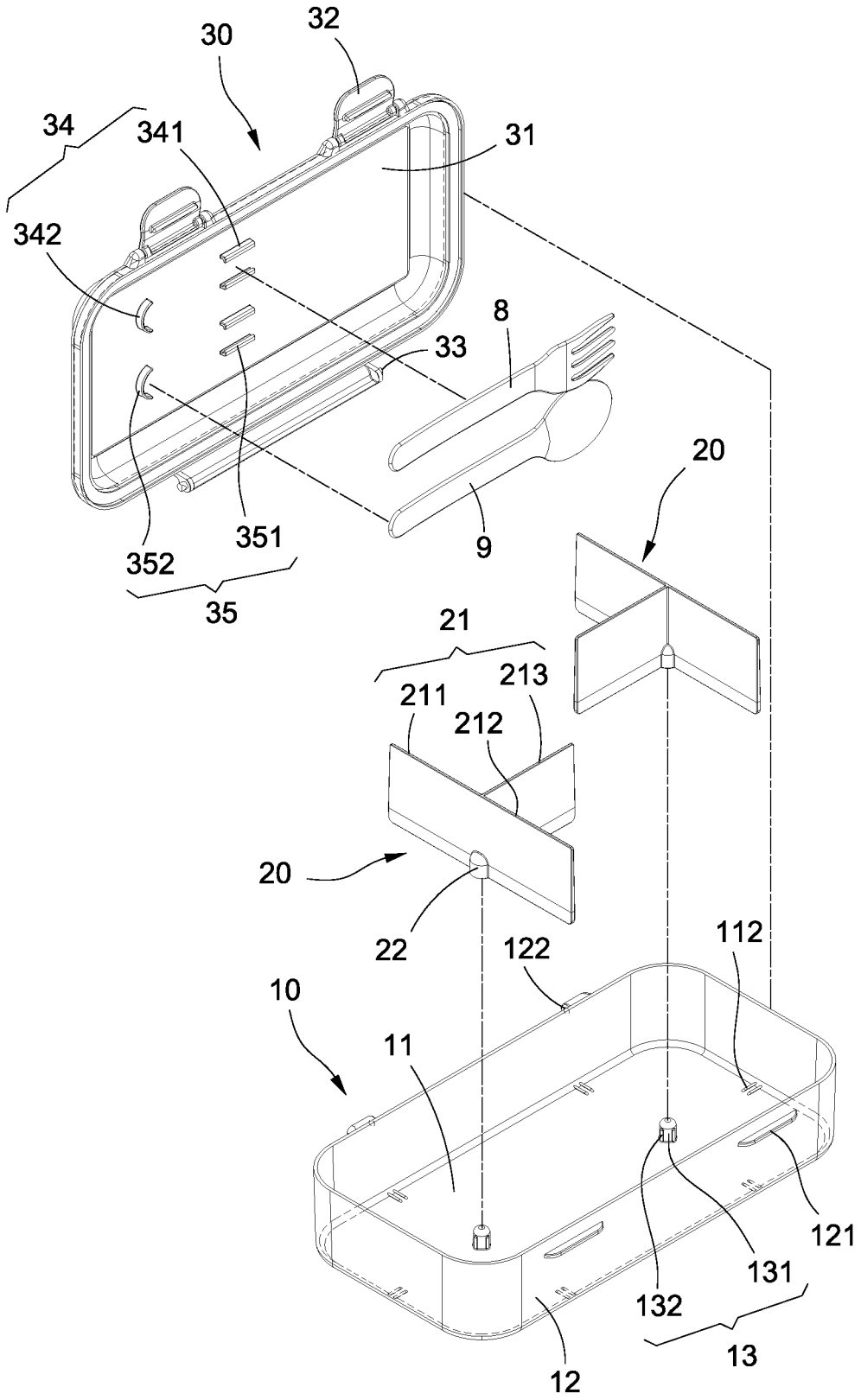
FIG. 1 is a perspective exploded view of the storage box of the present disclosure.
Figure 2:
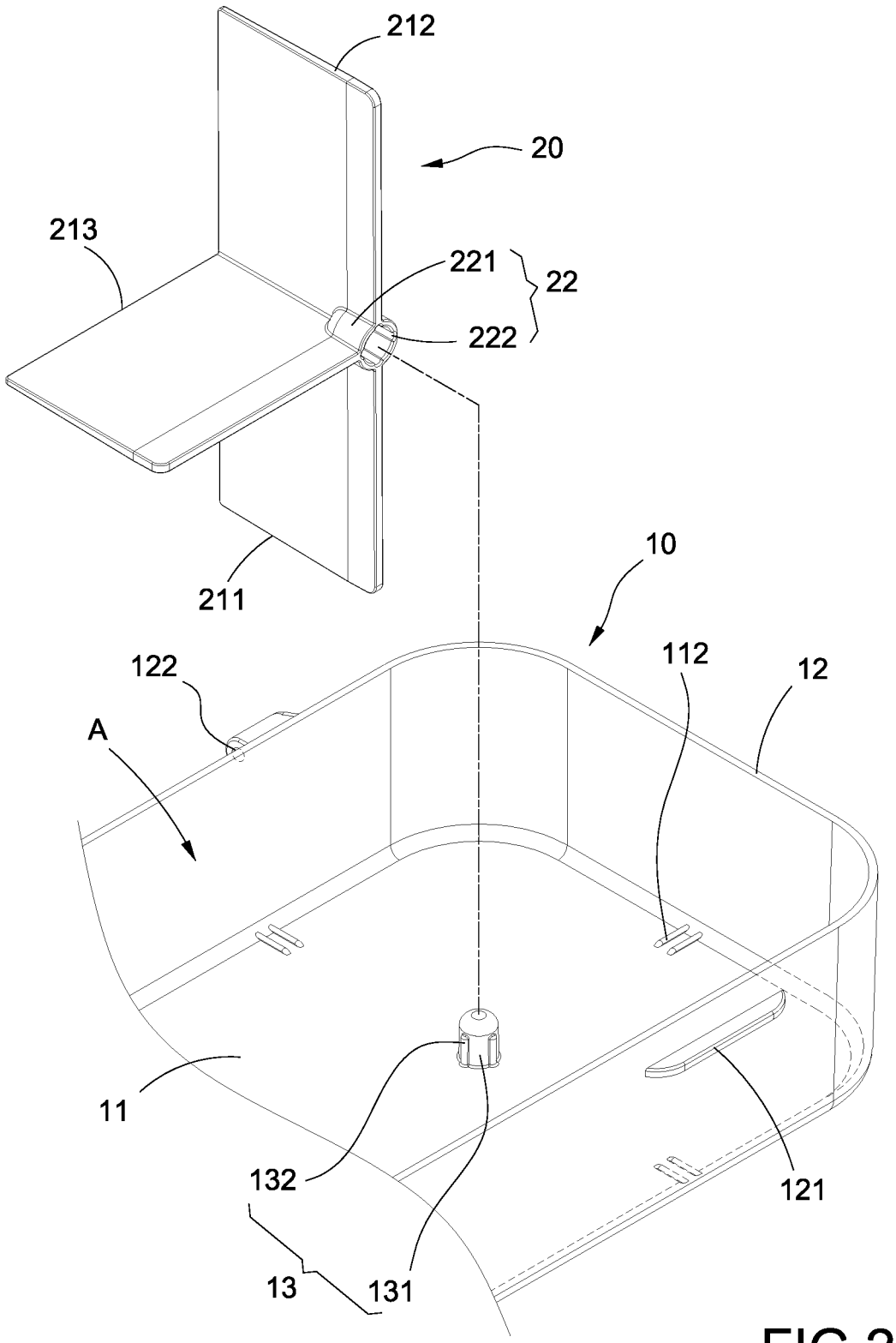
FIG. 2 is an exploded view of the storage box and the partition board of the present disclosure.
Figure 3:
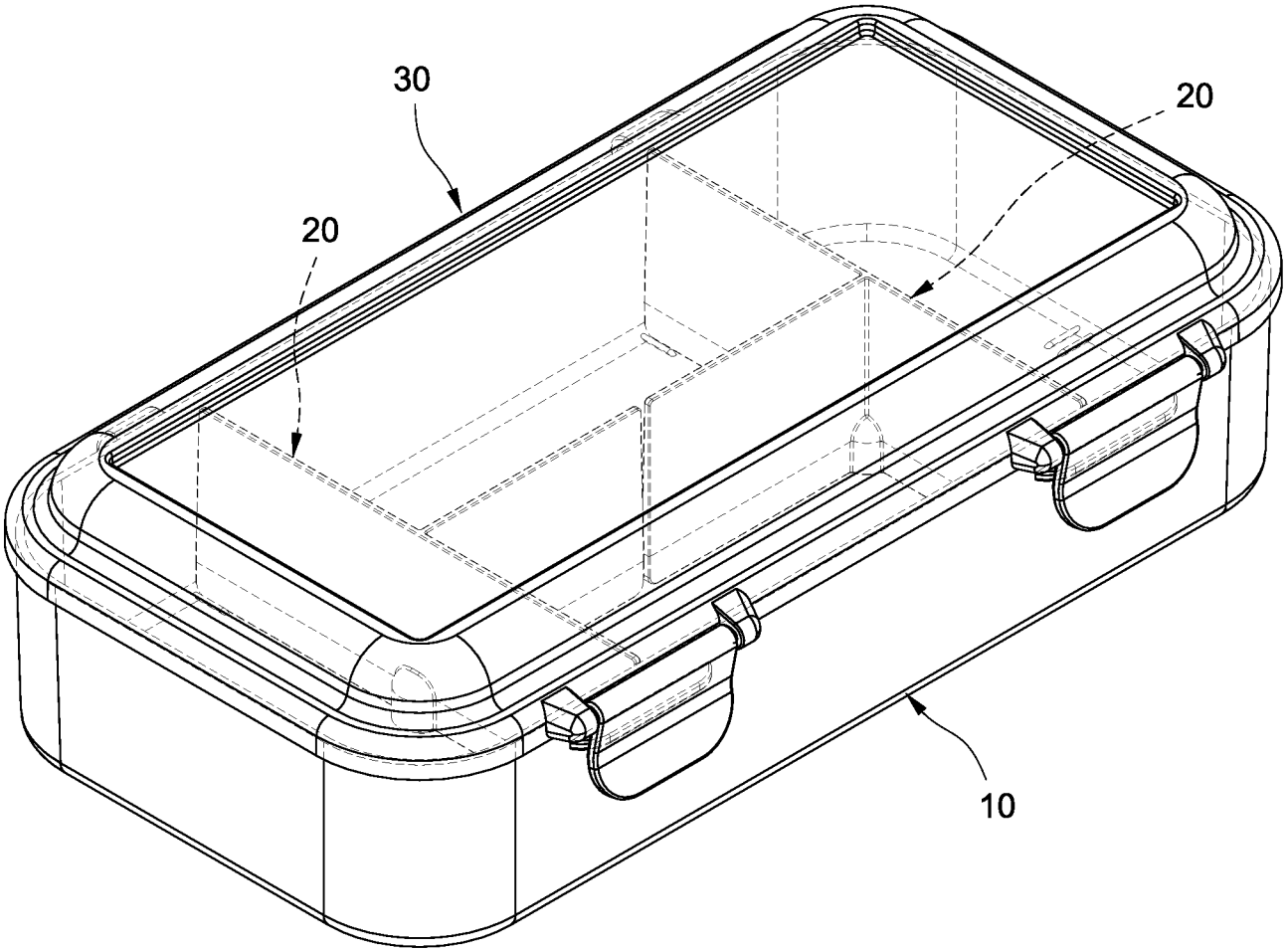
FIG. 3 is an assembly perspective view of the storage box of the present disclosure.
Figure 5:
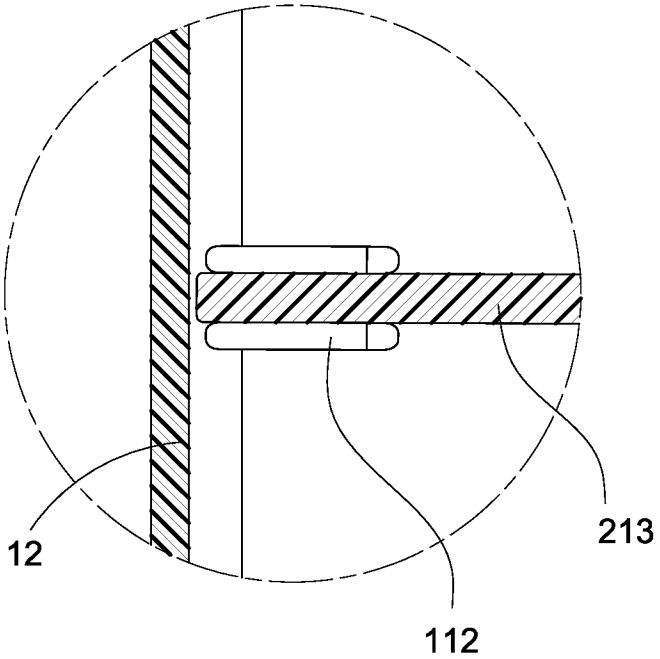
FIG. 5 is a schematic view showing the sheets being secured by each positioning strip of the present disclosure.
Figure 4:
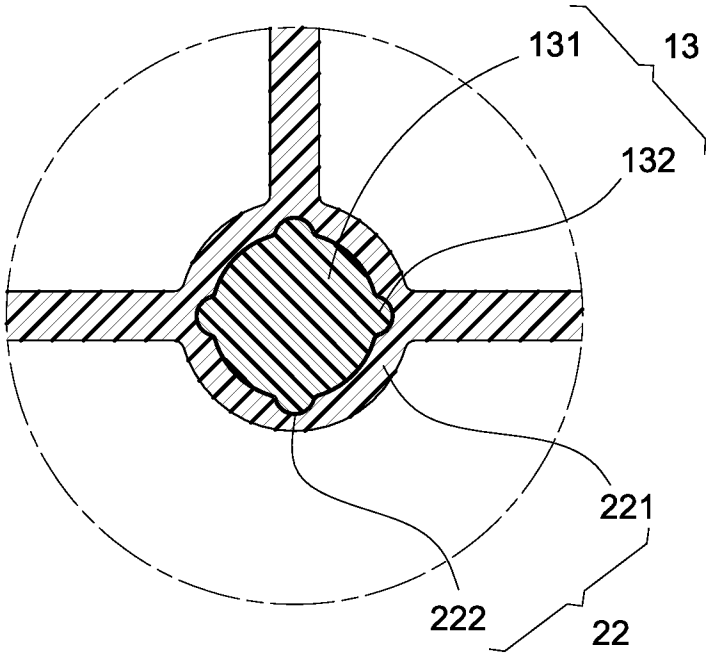
FIG. 4 is an assembly cross sectional view of the hinge portion and the rotating portion of the present disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIG. 1 to FIG. 5, which show a storage box with rotatably changing compartments of the present disclosure, and the storage box, such as a meal box or a lunch box, mainly includes a box body 10, at least one partition board 20 and a box cover 30.

The box body 10 may be made of a food-grade plastic material, and it mainly includes a rectangular base plate 11 and a vertical plate 12 bent and extended upward from a perimeter of the base plate 11, and a storage space A is enclosed by the vertical plate 12 and the base plate 11. A hinge portion 12 is arranged on the base plate 11 at a distance away from the vertical plate 12. In an exemplary embodiment, the hinge portion 13 includes a protruding shaft 131 and a plurality of insertion ribs 132. the present disclosure is not limited to such configuration only, such that it may only include the protruding shaft 131, and the quantity of the hinge portion 13 may be two or more than two. Each one of the protruding ribs 132 is formed on a circumferential wall of the protruding shaft 131. The base plate 11 includes a plurality of positioning strips 112 formed at locations corresponding to the hinge portion 13 and adjacent to the vertical plate 12. Furthermore, the outer side wall of the vertical plate 12 includes a pair of locking strips 121 and a pair of hinge holes 122. Each one of the locking strips 121 and each one of the hinge holes 122 are formed at two opposite outer side wall of the vertical plate 12.

In an exemplary embodiment, the quantity of the partition board 20 is two, or it may be a single partition board type. Each one of the partition board 20 mainly includes a board member 21 and a rotating portion 22. In this exemplary embodiment, the board member 21 mainly includes a first sheet 211, a second sheet 212 extended parallelly from the first sheet 211 and a third sheet 213 extended perpendicularly to the first sheet 211 and the second sheet 212, such that the first sheet 211, the second sheet 212 and the third sheet 213 are structured in a T-shape. In addition, the first sheet 211, the second sheet 212 and the third sheet 213 are equal in length. The rotating portion 22 is formed at an intersection of the first sheet 211, the second sheet 212 and the third sheet 213. In addition, in this exemplary embodiment, the rotating portion 22 includes a sleeve 221 and a plurality of insertion slots 222, the present disclosure is not limited to such configuration only, and it may include the sleeve 221 only. Each one of the insertion slots 222 is formed at the inner wall of the sleeve 221. The rotating portion 22 is rotatably attached to the hinge portion 13 correspondingly, and each one of the insertion slots 222 is inserted into each one of the corresponding insertion slots 132 respectively for positioning. The end portions of the first sheet 211, the second sheet 212 and the third sheet 213 are retained by the positioning strips 112.

The box cover 30 correspondingly covers the box body 10, and it mainly includes a cover plate 31, a fastener 32 connected to one side edge of the cover plate 30 and a hinge axle 33 connected to another side edge of the cover plate 31. The hinge axle 33 penetrates through the hinge hole 122 correspondingly, and each one of the fasteners 32 is locked and attached to each one of the locking strips 121 correspondingly.

Furthermore, the box cover 30 of the present disclosure further includes a fork fixation portion 34. The fork fixation portion 34 is arranged at the inner side surface of the cover plate 31, and it mainly includes a pair of holding strips 341 and an arched positioning strips 342 for accommodating a fork 8.

Moreover, the box cover 30 of the present disclosure further includes a spoon fixation portion 35. The spoon fixation portion 35 is arranged at the inner side surface of the cover plate 31 and is formed at one side of the fork fixation portion 34. The spoon fixation portion 35 mainly includes a pair of retaining strips 351 and an arched retaining strip 352 for accommodating a spoon 9.

Figure 6:
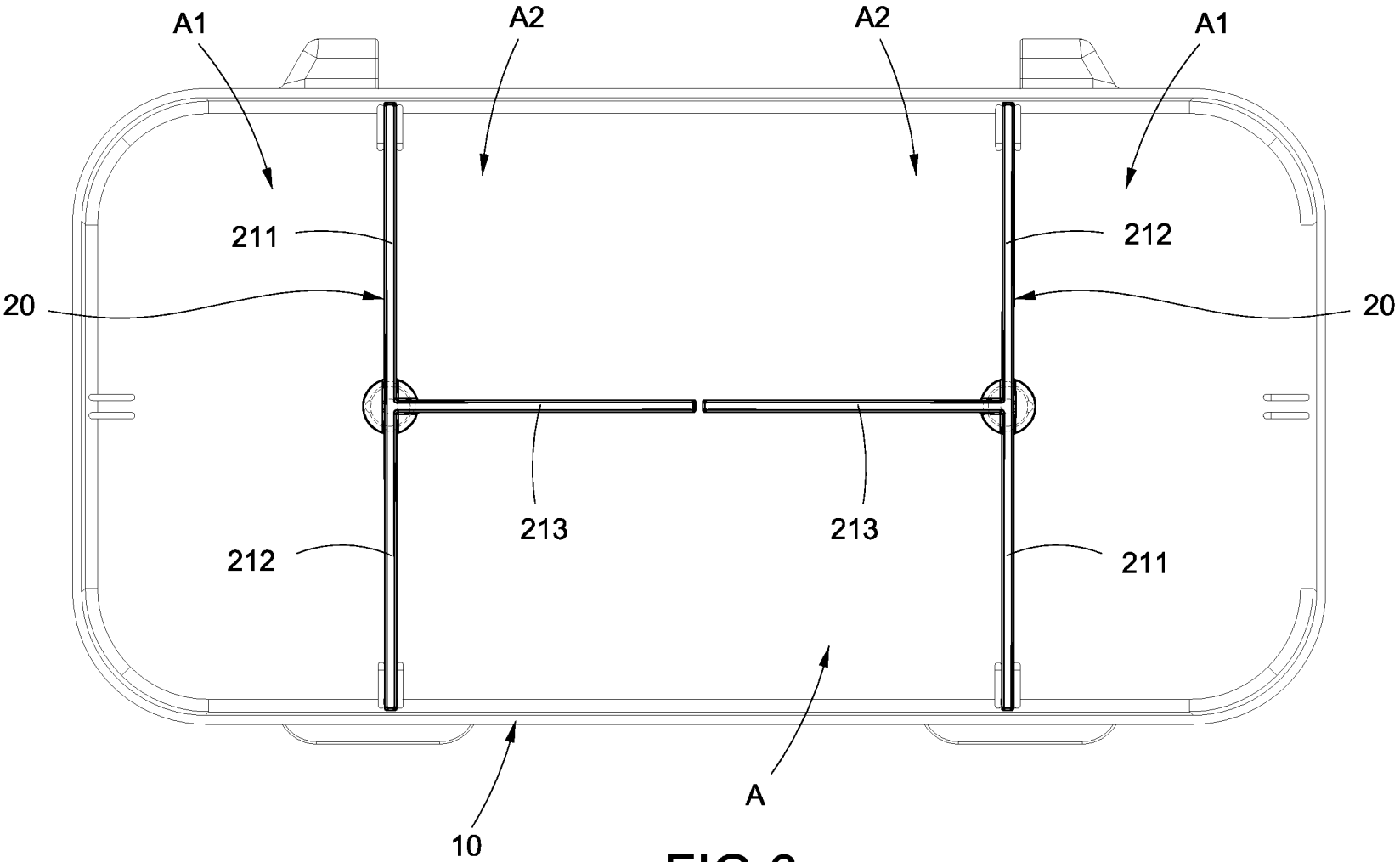
FIG. 6 is a top view showing the first state of use of the box body and the partition boards of the present disclosure.

As shown in FIG. 6, during use of the storage box, the rotating portion 22 of the partition board 20 is attached to the hinge portion 13 correspondingly. The board member 21 is formed inside the storage space A. The board member 21 may divide the storage space A into a first compartment A1 and a second compartment A2 according to the actual use needs.

To be more specific, when the hinge portion 13 is a protruding shaft 131, and the rotating portion 22 is a sleeve 221, the sleeve 221 is directly mounted on the protruding shaft 131. The hinge portion 13 includes the protruding shaft 131 and the insertion ribs 132. The rotating portion 22 includes the sleeve 221 and the insertion slots 222. Accordingly, the sleeve 221 is mounted on the protruding shaft 131, and each one of the insertion ribs 132 is inserted into each one of the insertion slots 222 respectively. The board member 21 may be rotated via the deformation of the sleeve 221, and the partition board 20 may also be removed from the hinge portion 13. Furthermore, the partition board 20 may be rotated by an appropriate angle, following which the sleeve 221 and the insertion slots 222 may be attached to the protruding shaft 131 and the insertion ribs 132 correspondingly.

In an exemplary embodiment, each one of the hinge portion 13 and the partition board 20 has a quantity of two respectively. The first sheet 211 and the second sheet 212 of one of the board members 21 are arranged parallelly to the first sheet 211 and the second sheet 212 of another one of the board members 21, and the third sheet 213 of one of the board members 21 and the third sheet 213 of another one of the board members 21 are arranged in a direction facing toward each other.

Figure 7:
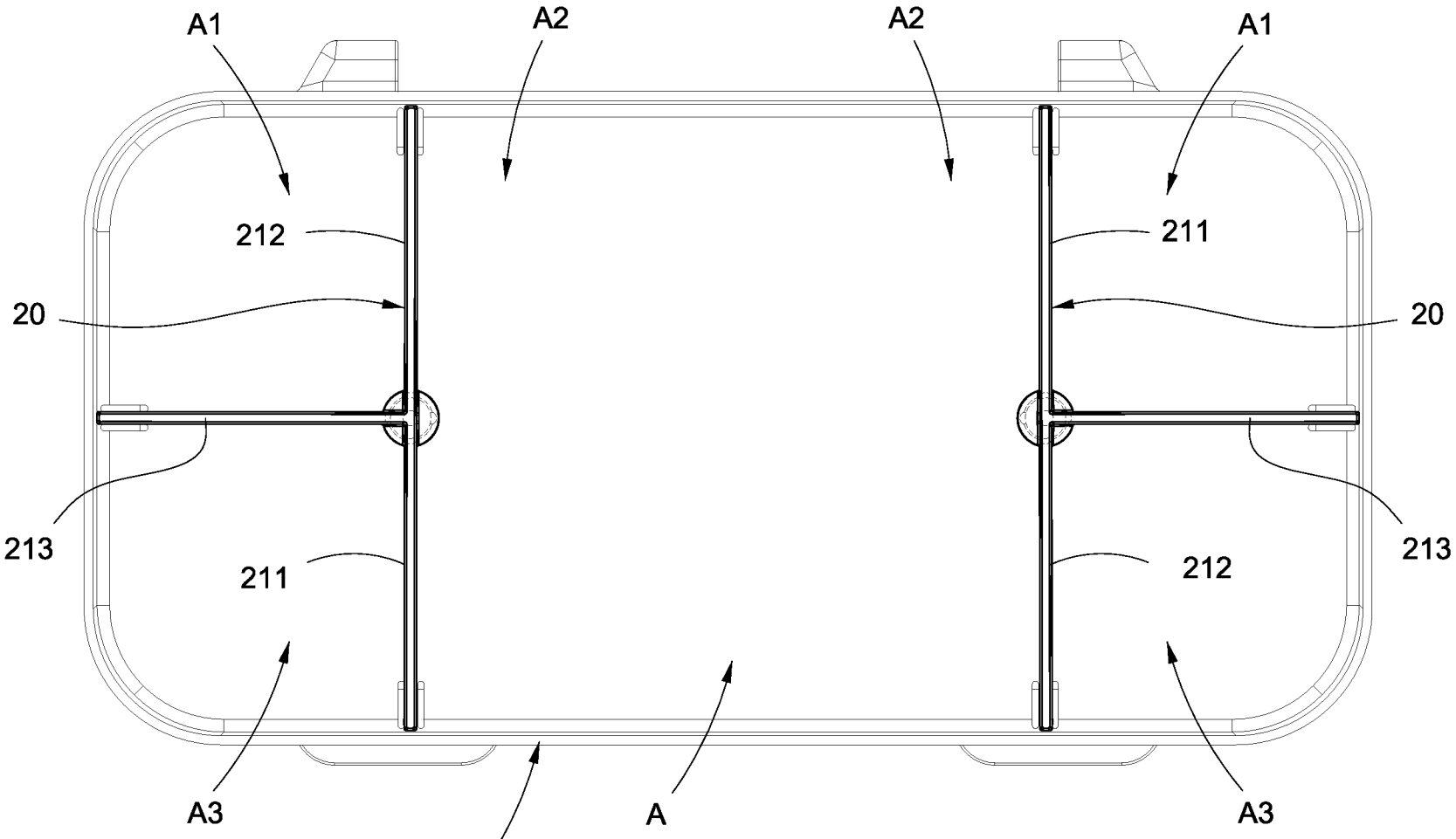
FIG. 7 is a top view showing the second state of use of the box body and the partition boards of the present disclosure.

Please refer to FIG. 7. After the third sheet 213 of the partition board 20 deviates toward the short edge of the vertical plate 12 and is positioned, a first compartment A1 is formed by the second sheet 212, the third sheet 213 and the vertical plate 12, a second compartment A2 is formed by the first sheet 211 and the outer side of the second sheet 212, and a third compartment A3 is formed by the first sheet 211, the third sheet 213 and the vertical plate 12. Similarly, another partition board 20 may also be used to divide the other half of the storage space A into the first compartment A1, the second compartment A2 and the third compartment A3.

Furthermore, in an exemplary embodiment, each one of the hinge portion 13 and the partition board 20 has a quantity of two respectively. The first sheet 211 and the second sheet 212 of one of the board members 21 are arranged parallelly to the first sheet 211 and the second sheet 212 of another one of the board members 21, and the third sheet 213 of one of the board members 21 and the third sheet 213 of another one of the board members 21 are arranged in a direction away from each other.

Figure 8:
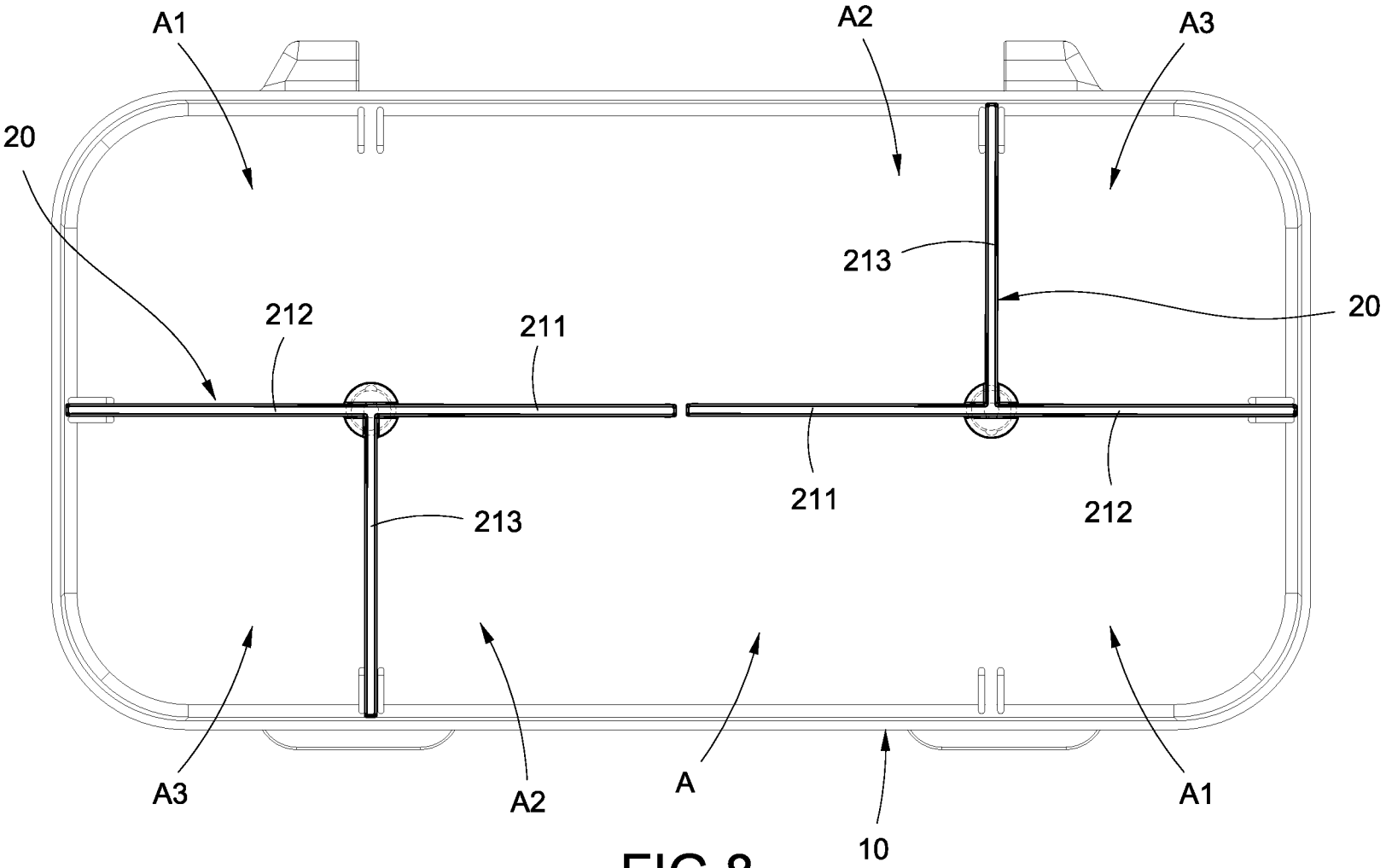
FIG. 8 is a top view showing the third state of use of the box body and the partition boards of the present disclosure.

Please refer to FIG. 8. After the third sheet 213 of the partition board 20 deviates toward the long edge of the vertical plate 12 and is positioned, a first compartment A1 is formed by the first sheet 211, the second sheet 212 and the vertical plate 12, a second compartment A2 is formed by the first sheet 211, the third sheet 213 and the vertical plate 12, and a third compartment A3 is formed by the second sheet 212, the third sheet 213 and the vertical plate 12. Similarly, another partition board 20 may also be used to divide the other half of the storage space A into the first compartment A1, the second compartment A2 and the third compartment A3.

Moreover, in an exemplary embodiment, each one of the hinge portion 13 and the partition board 20 has a quantity of two respectively. The first sheet 211 and the second sheet 212 of one of the board members 21 are arranged linearly with the first sheet 211 and the second sheet 212 of another one of the board members 21, and the third sheet 213 of one of the board members 21 and the third sheet 213 of another one of the board members 21 are arranged to face toward different directions.

In view of the above, the storage box with rotatably changing compartments of the present disclosure is able to achieve the expected purpose of use, to overcome drawbacks of known technologies and is equipped with industrial practicality, The above description is provided to illustrate the exemplary embodiments of the present disclosure only such that it shall not be treated as limitation to the claimed scope of the present disclosure. In addition, any equivalent modification made based on the present disclosure shall be considered to be within the claimed scope of the present disclosure.

What is claimed is:

1. A storage box with rotatably changing compartments, the storage box comprising:

a box body, comprising a base plate and a vertical plate bent and extended from the base plate, a storage space enclosed by the vertical plate and the base plate, the base plate comprising a hinge portion;

at least one partition board, comprising a board member and a rotating portion arranged on the board member, the board member rotatably attached to the hinge portion, wherein the storage space is divided into a first compartment and a second compartment via the board member; and a box cover, covering the box body, wherein the hinge portion comprises a protruding shaft, the rotating portion comprises a sleeve, and the sleeve is mounted on the protruding shaft;

wherein the hinge portion further comprises a plurality of insertion ribs disposed on the protruding shaft and in parallel with an axial direction of the protruding shaft, the rotating portion further comprises a plurality of insertion slots arranged in the sleeve, and each one of the insertion ribs is inserted in each one of the insertion slots in position.

2. The storage box with rotatably changing compartments according to claim 1, wherein the board member comprises a first sheet, a second sheet extended parallelly from the first sheet, and a third sheet extended perpendicularly to the first sheet and the second sheet, and the first sheet, the second sheet and the third sheet are structured in a T-shape.

3. The storage box with rotatably changing compartments according to claim 2, wherein the rotating portion is disposed at an intersection of the first sheet, the second sheet and the third sheet, and the first sheet, the second sheet and the third sheet are equal in length.

4. The storage box with rotatably changing compartments according to claim 3, wherein the base plate comprises a plurality of positioning strips disposed at a location corresponding to the hinge portion and adjacent to the vertical plate, the first sheet, the second sheet and the third sheet are retained by each one of the positioning strips at one ends thereof away from the rotating portion respectively.

5. The storage box with rotatably changing compartments according to claim 1, wherein each one of the hinge portion and the partition board has a quantity of two respectively, each one of the board members comprises a first sheet, a second sheet extended parallelly from the first sheet, and a third sheet extended perpendicularly to the first sheet and the second sheet, the first sheet and the second sheet of one of the board members are arranged parallelly to the first sheet and the second sheet of another one of the board members, and the third sheet of one of the board members and the third sheet of another one of the board members are arranged in a direction facing toward each other.

6. The storage box with rotatably changing compartments according to claim 1, wherein each one of the hinge portion and the partition board has a quantity of two respectively, each one of the board members comprises a first sheet, a second sheet extended parallelly from the first sheet, and a third sheet extended perpendicularly to the first sheet and the second sheet, the first sheet and the second sheet of one of the board members are arranged parallelly to the first sheet and the second sheet of another one of the board members, and the third sheet of one of the board members and the third sheet of another one of the board members are arranged in a direction away from each other.

7. The storage box with rotatably changing compartments according to claim 1, wherein each one of the hinge portion and the partition board has a quantity of two respectively, each one of the board members comprises a first sheet, a second sheet extended parallelly to the first sheet, and a third sheet extended perpendicularly to the first sheet and the second sheet, the first sheet and the second sheet of one of the board members are arranged linearly with the first sheet and the second sheet of another one of the board members, and the third sheet of one of the board members and the third sheet of another one of the board members are arranged to face toward different directions.

8. The storage box with rotatably changing compartments according to claim 1, wherein the box cover comprises a cover plate, a spoon fixation portion and a fork fixation portion, the spoon fixation portion and the fork fixation portion are arranged inside the cover plate.

* * * * *